United States Patent [19]

Gantz et al.

[11] 4,377,973

[45] Mar. 29, 1983

[54] SUPPORT FOR A TYPE BELT OF A LINE PRINTER

[75] Inventors: Bruno Gantz, Herrenberg; Horst D. Matthaei, Waldenbuch, both of Fed. Rep. of Germany

[73] Assignee: International Business Machines Corporation, Armonk, N.Y.

[21] Appl. No.: 263,622

[22] Filed: May 14, 1981

[30] Foreign Application Priority Data

Aug. 21, 1980 [DE] Fed. Rep. of Germany ..... 80104963

[51] Int. Cl.[3] ..... B41J 1/20

[52] U.S. Cl. ..... 101/111; 400/146; 400/554; 400/649; 400/652

[58] Field of Search ..... 101/111; 400/554, 146, 400/643, 649, 652, 659

[56] References Cited

U.S. PATENT DOCUMENTS

| | | | |
|---|---|---|---|
| 2,083,365 | 6/1937 | Dodge | 400/554 |
| 2,858,926 | 11/1958 | Metzner | 400/554 |
| 4,211,166 | 7/1980 | Hardt | 101/111 |
| 4,294,556 | 10/1981 | Rix | 400/643 |

*Primary Examiner*—Edgar S. Burr
*Assistant Examiner*—Bradley M. Lewis
*Attorney, Agent, or Firm*—John S. Gasper

[57] ABSTRACT

The continuous type belt is arranged round two rollers, one of which is driven. One straight section of the type belt contacts over its entire length the support designed as a platen.

In order to avoid groove on the platen caused by the rotating type belt, and to achieve a distribution of other kinds of wear of the platen over its circumference, a gear motor causes the platen to rotate very slowly (approximately 1 revolution in 72 hours).

The platen can also be rotated without a gear motor. For this purpose, the longitudinal axis of the platen is slightly inclined relative to the edge of the type belt. This inclination effects a small movement component in the direction of the platen circumference while the type belt slides along the lateral surface of the platen, said component causing a slow revolution of the platen.

3 Claims, 3 Drawing Figures

SUPPORT FOR A TYPE BELT OF A LINE PRINTER

TECHNICAL FIELD

The invention relates to a support for a revolving continuous type belt of a line printer which is arranged round two rollers, and whose one straight section extending in parallel to the printing line rests against the support, an inking web and the print paper passing between the above section and the row of print hammers.

In line printers of the above described type, a type belt comprising a steel tape with print types protruding from a plane has preferably been used in recent times. During printing, this type belt is supported on its back by a flat stationary platen serving as a type belt support. Owing to the movement of the steel tape and the print hammer force, the wear of the stationary platen by the type belt is considerable. Particularly in printers with higher print output and type belt speed the steel tape makes grooves in the platen which considerably affect the print quality.

BACKGROUND ART

It is known from U.S. patent application of W. Hasler et al entitled Type Belt Printer, Ser. No. 127,614, filed Mar. 6, 1980 which is a continuation of earlier application Ser. No. 885,058 filed Mar. 9, 1978, now abandoned to reduce the wear of a support and its deformation in the type area in that between the type belt and the platen support a revolving intermediate tape of metal or synthetic material is arranged. The intermediate tape is continuous and moves over two pulleys, and it is stretched by a flexible tension pulley. The straight section of the intermediate tape adjacent to the type belt moves in the same direction as the type belt but with a lower speed. The intermediate tape can be driven either separately, or it can be taken along by friction in the direction of the type belt movement.

DISCLOSURE OF THE INVENTION

It is an object of this invention to provide an improved support for a type belt in a line printer device in which the lifetime of the support is increased considerably. The improved support comprises a cylindrical or roller support platen which is continuously rotated. The advantages achieved by the present invention substantially consist in that the technical complexity of an intermediate tape is avoided, and that furthermore the support surface is considerably increased in that a rotating cylindrical or roller type platen is used. The wear of the support as disclosed by the invention is thus reduced to such an extent that the lifetime of the support exceeds that of the printer. Owing to the invention, an exchange of the support is sure to be unnecessary. Furthermore, the invention improves the print quality of a line printer in that, owing to the curved surface the cylindrical or roller shape of the platen support provides, the air between type belt and support can escape more quickly than with the flat platen support so that the first type to be activated in a printing line produces a character which is as clearly visible as the following characters of this printing line. Also due to the cylindrical or roll contour of the cylindrical platen support, the type belt, upon the impact by the print hammers, can align itself transversely to its length along with the print medium so at to assure parallelism with the print hammer face so that upper and lower part of the printed character are not of different thickness.

Although roller platen supports are used in typewriters and wire printers these impact platens have another function owing to the absence of a revolving type belt.

BRIEF DESCRIPTION OF THE DRAWING

The invention will be described in connection with the drawing in which.

DETAILED DESCRIPTION OF THE INVENTION

Figure 1:
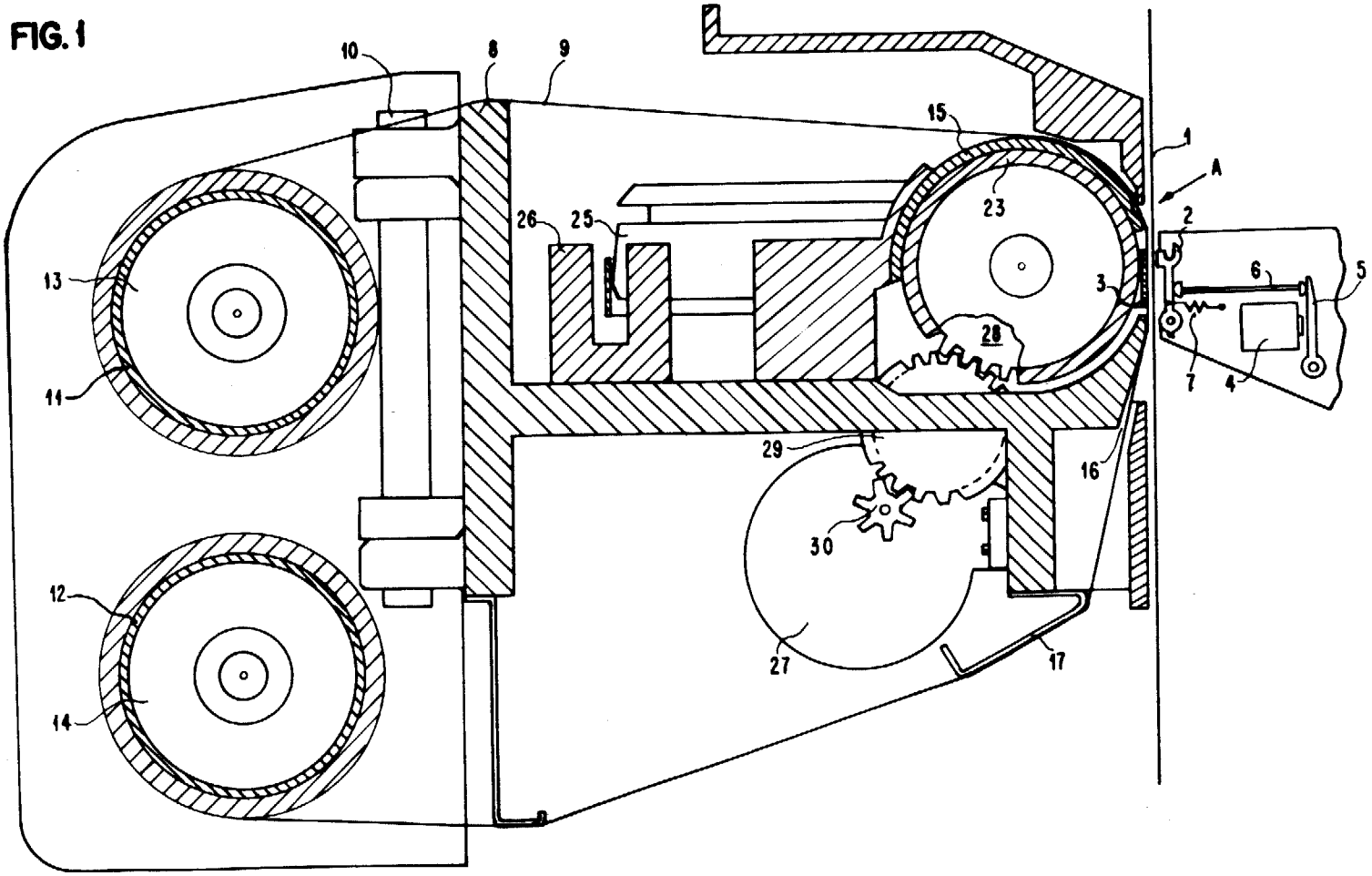
FIG. 1 is a section through a line printer comprising the invention

Print paper 1 passes through a slot formed by a series of print hammers 2 and inking web 9. Each print hammer 2 has an associated drive electromagnet 4 whose armature 5, via a push rod 6, moves the print hammer 2 toward print paper 1 against the force of spring 7. Print hammers 2 face the back of print paper 1. Preceding the front side of print paper 1, there is frame 8 containing type belt 3 and inking web 9. Frame 8 pivots around bolt 10 to provide free access to print paper 1. Inking web 9 whose width corresponds to the length of the printing line moves to and fro between two rollers 11 and 12, one serving as reservoir roller and the other as winding roller. With both their ends, the two rollers are placed onto carrier disks 13 and 14, and joined thereto in form-locking connection. Each carrier disk 13 and 14 is connected to one respective electric motor (not shown). The elctric motor associated to the reservoir roller generates a braking moment to keep inking web 9 stretched. Inking web 9 which in FIG. 1 is removed from roller 11 is guided via arc-shaped guide 15, and at a small distance from type ribbon 3 it is directed into channel 16, and there it reaches roller 12 via diverting sheet 17.

Figure 2:
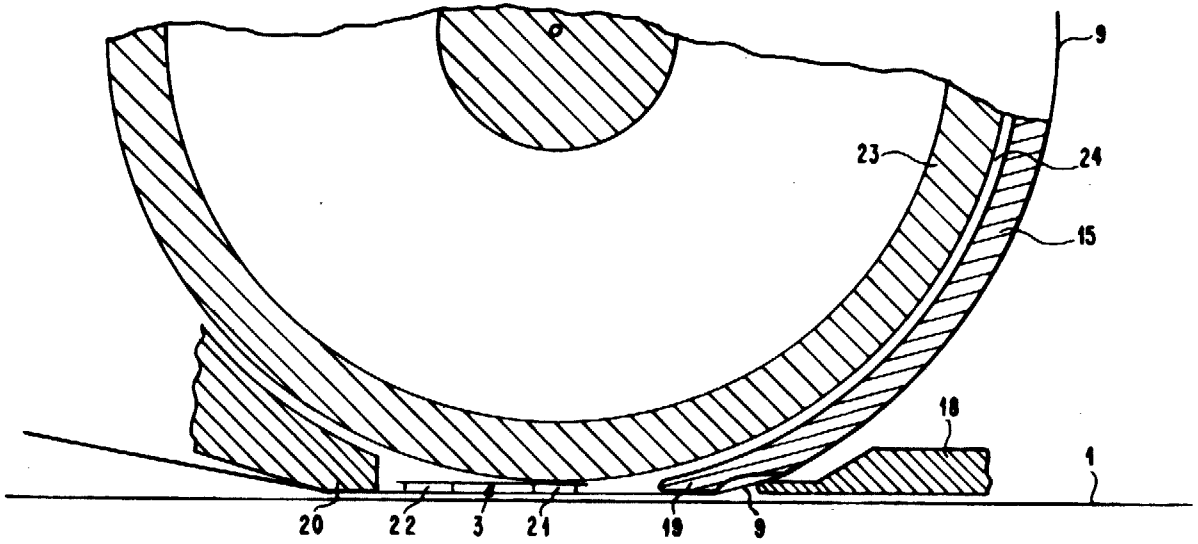
FIG. 2 is an enlargement of area A in FIG. 1.

FIG. 2 is large-scale representation of area A of FIG. 1 to give a detailed view of the transport of inking web 9 and its position relative to type ribbon 3. Over type belt 3, between print paper 1 and arc-shaped guide 15, tongue 18 is arranged which prevents a contact between inking web 9 and print paper 1. Inking web 9 moving between tongue 18 and arc-shaped guide 15 is transported over the end of arc-shaped guide 15 which represents guide plane 19 which together with guide plane 20 arranged beneath type belt 3 provides a distance between inking web 9 and types 21 or timing marks 22 of type ribbon 3, respectively.

Arc-shaped guide 15 is arranged concentrically to platen 23 acting as support. The diameter of platen 23 is such that the curvature of the lateral surface of the cylinder is at a ratio to the height of the printed character which prevents the height of arc of the support under the impacted character from reaching such an extent that the upper and lower parts of the types appear only in weak print. With a height of 3.2 mm of the surface element of platen 23 supporting the types, and a diameter of the latter of 50 mm, the height of arc is $51\mu$ so that the print quality is not affected.

Between arc-shaped guide 15 and platen 23 gap 24 is provided which is of importance in particular for the electromotor-less drive of platen 23 described below to keep the friction moments acting against the drive as low as possible.

Type belt 3 moves over rollers 25 one of which is being driven. Type belt 3 consists of steel and shows types 21 and timing marks 22 protruding from the type belt surface owing to etching or embossimg. In printers with a high printing output the revolving speed of type belt 3 is considerable. Type belt 3 contacts platen 23 at its side facing print paper 1 over its entire length, and the other straight section of type belt 3 extends through the gap of U-shaped protective ledge 26.

To avoid grooves and to distribute other kinds of wear of platen 23 over its circumference, gear motor 27 causes platen 23 to execute a very slow rotation (approximately one rotation in 72 hours). For this purpose, platen 23 is connected to gear 28 which via intermediate gear 29 is connected to gear 30 of gear motor 27.

Figure 3:
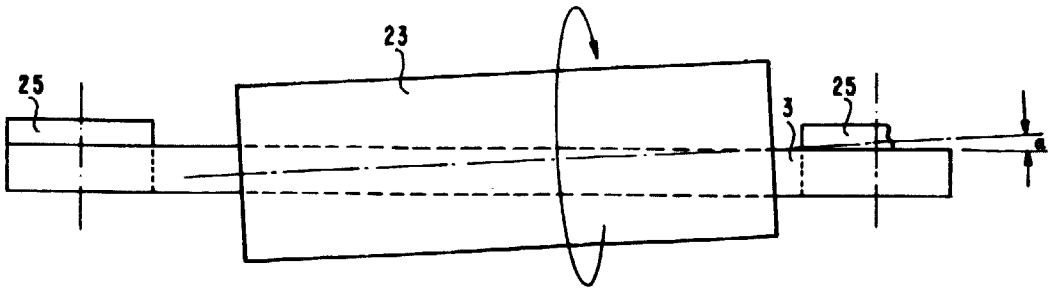
FIG. 3 is a schematic representation of another embodiment of the invention.

A suitable platen for practicing the invention is made of steel having a surface coating of a material such as titanium oxide. As specified above, platen 23 can be driven also without the help of gear motor 27. In such an embodiment of the invention (FIG. 3) the longitudinal axis of platen 23 is slightly inclined relative to the edge of type belt 3. The angle of inclination a amounts to 2 to 6 minutes of angle. This inclination generates a small movement component in the direction of the platen circumference while type belt 3 slides along the lateral surface of platen 23, said component effecting a slow rotation of platen 23. The rotational speed of platen 23 can be altered by altering the angle of inclination. However, platen 23 should not be inclined to such an extent that the contact line between type belt and platen for the types of the marginal zone of the printing line is no longer within the type field.

We claim:

1. A line printer apparatus comprising in combination a revolving continuous type belt guided round two rollers or the like, said type belt having a straight section between said rollers extending along a print line, print hammer means positioned along said print line for impacting a print medium against type on the outer surface of said revolving type belt, and support means for said type belt comprising a cylindrical platen support member having its peripheral surface resting against said straight section of said revolving type belt in contact with the type belt surface opposite said print hammers, said platen support being rotated continuously with a low circumferential speed with said peripheral surface resting against said opposite type belt surface.

2. A printer apparatus in accordance with claim 1, in which said platen has its longitudinal axis slightly inclined toward the edge of the straight section of the type belt whereby said platen support is continuously rotated by frictional engagement of said revolving type belt and said platen support surface.

3. A printer apparatus in accordance with claim 1, in which said platen is firmly connected for continuous rotation to a gear or the like which is in engagement with a drive motor.

* * * * *